United States Patent [19]

Byer

[11] 4,045,900

[45] Sept. 6, 1977

[54] GUN CLEANER

[76] Inventor: John A. Byer, 820 S. Maryland St., Apt. 107, Los Angeles, Calif. 91205

[21] Appl. No.: 700,766

[22] Filed: June 29, 1976

[51] Int. Cl.[2] ..... F41C 31/00

[52] U.S. Cl. ..... 42/1 R

[58] Field of Search ..... 42/1 R, 90, 1 N

[56] References Cited

U.S. PATENT DOCUMENTS

| | | | |
|---|---|---|---|
| 1,050,678 | 1/1913 | Moreno | 42/1 R |
| 1,484,690 | 2/1924 | Walker et al. | 42/1 R |
| 1,535,124 | 4/1925 | Laughlin | 42/1 R |
| 1,614,129 | 1/1927 | Hoskins | 42/1 R |
| 3,813,802 | 6/1974 | DiProspero | 42/1 R |

*Primary Examiner*—Charles T. Jordan
*Attorney, Agent, or Firm*—Whann & McManigal

[57] ABSTRACT

A gun cleaner consisting of a plastic bag having a pouch adapted to receive the gun to be cleaned with its barrel pointed downward, and having an elongated barrel-receiving portion of reduced cross-sectional size, the bag being adjustable so that the barrel-receiving portion may be of a length suitable to receive the barrel of the gun. The barrel-receiving portion is foldable to a position in which the length of the barrel-receiving portion accommodates the gun barrel yet is not so large that it uses an excessive amount of cleaning solution or solvent. The barrel-receiving portion may be unfolded into a position to form a solvent or liquid cleaner-receiving chamber below the barrel so that this liquid may flow or drain downwardly into said solvent-receiving chamber. Also the lower end of the barrel-receiving portion may after the liquid has drained into the receiving chamber and the sediment of dirt settled therefrom, be folded to contain the sediment in a small area so that the cleaning solvent may be decanted and retained for reuse. The dirt contained in the lower part of the barrel-receiving portion may be washed out, using a suitable detergent.

8 Claims, 5 Drawing Figures

-59-
-11-

GUN CLEANER

THE PRIOR ART

When a gun or other firearm is fired, lead and burned powder collects in the forward end of the cylinder and in the frame structure of the gun and around the inside of the barrel. The lead and burned powder builds up in locations which are difficult to clean with a brush; and, therefore, the cleaning operation may be tiresome and cumbersome. For example, gun cleaning must be repeatedly done by police officers who are required to qualify as a police officer every month and to use his gun regularly. After each practice firing session, the officer must clean his gun and this cleaning becomes a chore.

It the gun is not properly cleaned in these critical areas, the gun upon further use could result in jamming up and it has been the experience at certain police academies that failure of the gun to be cleaned at critical areas has resulted in many jammings.

At the present time it is common practice to clean the gun with a brush or a liquid volatile solvent, applying the solvent to the critical spots and using cloth pads, rags, etc. Also, there has been designed and there is on the market an ultrasound device which costs as much as one thousand dollars. In these devices the gun is placed in an open-top chamber positioned horizontally and a maximum amount of cleaning solvent is used. Also, it has been found from experience that this electrosonic device results in guns jamming if the solvent is not cleaned or filtered on a timely basis. Similarly, it does not adequately clean the critical portions of a revolver.

APPLICANT'S ADVANCE OVER THE PRIOR ART AND THE SPECIFIC OBJECT OF THE INENTION

Applicant's invention consists of a system of the type referred to in the abstract.

It is an object of my invention to provide a simple, economical, low cost gun cleaning system which is effective in cleaning the gun, particularly at the "hard to get to" places. My invention uses a minimum of solvent and is, therefore, economical from that standpoint; also, my invention provides for the draining of the solvent and the separation of the foreign material or dirt or contaminant out of the solvent, isolating this "contaminant" and then decanting the solvent solution for reuse.

It is a further object of my invention to provide my gun cleaning system with a gun container which has a pocket adapted to receive the gun and which is provided with an elongated barrel-receiving portion of reduced cross-sectional size which receives the barrel of the gun, the barrel-receiving portion being foldable so that the pocket formed by the barrel-receiving portion may be just deep enough to receive the barrel and thus conserve on cleaning solvent; and, also, in which the barrel-receiving portion may be lengthened to form a drain chamber below the barrel into which the solvent may gravitate, carrying with it the deposits of lead and burned powder.

In my invention the dirt contained in the solvent will settle to the bottom of the chamber, and when it is desired to reclaim the solvent, the very lower end of the chamber may be folded in order to isolate the contaminant.

It is a further object of my invention to provide an agitating means which is mounted on the gun and which direct gas bubbles through the cleaning solution at the critical areas in order to cause agitation which will increase the cleaning effectiveness of the solution at the vital spots.

Other objects of my invention will be made evident during the course of the following description of a preferred form of my invention.

DESCRIPTION OF THE PREFERRED EMBODIMENT

Figures 1, 2, 3, 4, 5:
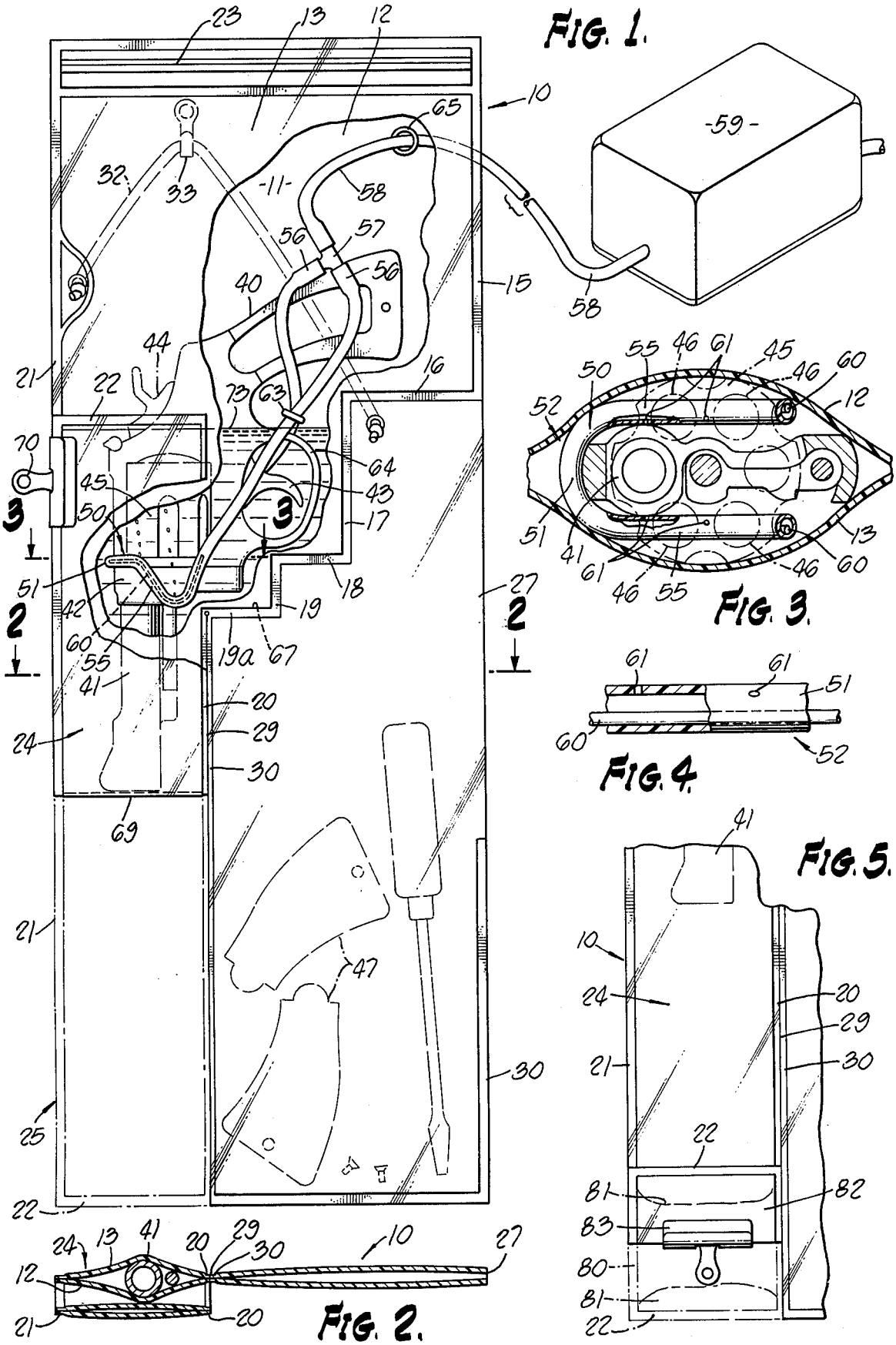
FIG. 1 is an elevational view of my invention with a portion of the plastic broken away to better illustrate the details, in this view the gun to be cleaned being shown in place and the soaking operation being performed.
FIG. 2 is a cross-sectional view taken on the line 2—2 of FIG. 1 and showing the manner in which the gun barrel is positioned in the barrel-receiving portion of the invention.
FIG. 3 is a cross-sectional view taken on the line 3—3 of FIG. 1 showing the manner in which the agitation means is mounted on the gun during the cleaning and agitating process.
FIG. 4 is a fragmentary sectional view showing the manner in which the wire reinforcement means is positioned in certain portions of the agitation means.
FIG. 5 is a fragmentary sectional view showing the manner in which the dirt, sediment or contaminant is isolated from the cleaning solvent.

As shown in FIG. 1, my invention provides a bag or container or enclosure 10 which is made from transparent plastic or other pliable material. The bag 10 provides a gun-receiving pocket or sack 11 which is positioned between a rearward wall 12 and a forward wall 13 of the bag.

The front and rear members of the bag are sealed together as indicated at 15, 16, 17, 18, 19, 19*a*, 20, 21 and 22. The upper portion of the bag comprises a receiving opening and after the gun has been installed in place for cleaning and after the cleaning fluid has been poured into the container or pocket or sack, the upper end of the bag can then be closed by the zipper arrangement 23.

The lower portion of the bag is provided with a barrel-receiving portion 24 which when the invention is not in use (or during draining), may be extended in a position parallel to the remainder of the bag as shown by the broken lines 25. Also the right-hand portion of the container 10 is provided in the form of a pouch having an opening at 27, whereby miscellaneous tools and handle parts of the gun being cleaned may be kept. It will be noted that where the plastic side walls 12 and 13 are secured together as indicated at 20, there is a separation line 29 and the part or seal marked 20 is a sealing of the edges of the barrel-receiving portion, and in addition to that there is the sealed edges 30 which form the boundary line of the pouch.

In order to hang the bag in a vertical position during the cleaning of the gun, there is provided a hanging strap 32 which may be extended around a supporting hook 33 mounted on a suitable vertical wall.

The firearm to be cleaned in this instance is a revolver having a handle 40, a barrel 41, a strap 42, trigger 43, hammer 44 and cylinder 45, which cylinder 45 has six cartridge-receiving chambers 46. The handle of the gun has handle portions which have been removed and have been positioned in the pouch, these handle portions are indicated by broken lines by the numerals 47, which handle portions may be made of wood, plastic, bone or some other material.

Before the gun is positioned as shown in FIG. 1 the agitating fixture 50, which is adjustable to fit various guns, is attached adjacent the end of the cylinder when the gun is positioned in the gun cleaner. This agitating fixture 50 has a curved joining part 51 of the tube 52 which comprises the fixture. Connected to each end of the joining portion 51 are the side tube portions 55 which extend around the frame and below the cylinder 45 as shown in FIGS. 1 and 3. The ends 56 of the tubular fixture 50 are connected by a T-fixture 57 to a tube 58 which extends to an air pump 59. The air pump when set into operation forces air through the agitation fixture.

It will be noted that in the form of the invention shown the side tubes 55 are curved downwardly as shown in FIG. 1 so that at this position they are below the lower end of the cylinder 45. It will be noted that there is a pliable wire 60 which can be bent into the desired shape in order to cause the agitation device to conform to the required shape. As shown in FIGS. 3 and 4 the tubular fixture is provided with small openings 61 suitably positioned so that air will be directed upwardly and so that it will also be directed inwardly so as to pass along the lower or forward end of the cylinder and into the chambers 46 and around the frame at the forward or lower end of the cylinder, these being the critical surfaces where the gun powder and lead are deposited when the gun is fired. In order to secure the agitation fixture to the gun as shown there is an adjustment ring 63 through which the two side tubes 55 are extended. This ring is slid downwardly so that it can bear against the trigger guard 64 and thus hold the agitation tube in place.

After the agitation fixture has been installed, the gun is then lowered into the bag in a position as shown in the drawings, particularly in FIG. 1. It is after the gun has been installed that the tube 58 is connected. The tube 58 may be connected at that time at the fixture 57 or it can be connected at some external joint. However, as shown, the tube 58 extends outwardly through a small opening 65 to the exterior of the bag and to the pump 59.

At this time the parts are in the position shown in the drawings, and FIG. 1 shows the gun barrel 41 projecting downwardly into the barrel-receiving portion 24. The gun is supported in this position because above where the barrel connects to the frame 42 the gun, of course, is enlarged and can rest upon the shoulder 67 formed by the sealing of the two side walls 12 and 13.

After the gun has been so positioned the barrel-receiving portion 24 which, up until now, is in an extended position, as indicated by dotted lines 25, is now folded as indicated at 69 and lower portion is brought upwardly into the position shown and is held in place by the clip 70. It will be noted that the available barrel-receiving portion is as long as the barrel, or it can be slightly longer than the barrel, and this is done purposely in order to cut down the volume within the bag and to reduce the amount of cleaning solvent which is required. As shown in FIG. 2, the barrel-receiving portion is so adjusted that it helps support the weight of the gun. Also, FIG. 2 shows how closely the walls 12 and 13 fit around the barrel and shows very clearly what a small volume there is in the barrel-receiving portion when this portion is in folded position.

Now the bag is ready to be put into operation and the first step is to fill the interior of the container with the cleaning solvent or liquid preferably up to a level 73, which will cover the entire cylinder 45. This amount of solvent is adequate to cover the parts of the gun which will be dirtied by the burnt powder and lead. The container is now hung on the hook 33 and the pump 59 is set into operation.

At this time the entire gun below the level 73 is surrounded by the solvent. Also air is being fed into the agitation fixture and will flow from the fixture through the various openings 61, the air bubbling upward and agitating the solvent. As previously pointed out, the agitation fixture is particularly designed to cause agitation adjacent those surfaces which are the "hard to get to" surfaces, and are the surfaces which become contaminated and if not cleaned might result in jamming.

In the use of the invention it is desirable to soak the gun for numerous hours. The person cleaning the gun could install the parts as shown, hang the container on the hook 33, connect the pump and allow the gun to soak for a period of time sufficient to perform the cleaning action.

When this cleaning is completed the pump is disconnected and the barrel-receiving portion is released from its folded position by removing the clamp 70 and swinging the lower portion of the barrel-receiving portion into the position shown by broken lines 25 in FIG. 1. When this is done the solvent moves downward to the bottom portion which is the drain chamber and the solvent removing itself from contact with the gun allows the draining action to take place so that the gun, when it is removed, has a minimum of wetness.

At this time the operator may open the entrance to the bag and after disconnecting the tube 58 remove the gun and then slip back the ring 63 and remove the agitation fixture from the gun.

The operator can then, if he desires, use a brush to finish up the areas which may need brushing. However, the brushing will be slight even at the critical areas because of the soaking in solvent and also the agitation of the cleaning solvent in these critical areas.

The agitation fixture is an important feature of my invention, however, if the gun is not too dirty the agitation fixture need not be used. That, of course, is the option of the person cleaning the gun.

The gun is wiped dry and is ready for service.

With respect to the solvent which is drained downwardly into the chamber at the lower end of the barrel-receiving portion, the sediment or dirt will have been collected in the very lower end of this portion which is indicated by the numeral 80 which extends to the broken lines; and the collected dirt or contaminant is indicated by dotted lines 81. At this time the operator will fold the lower end of the barrel-receiving portion upwardly into the position shown by full lines 82 and by then applying the clamp 83. It will be noted that the sediment or dirt 81 is now isolated from the remainder of the lower portion of the barrel-receiving portion. The operator can then tilt the bag and decant the cleaning solution or solvent from the upper end of the bag. The solvent having the dirt or contaminant settled out of it is ready for re-use as desired.

After this is done the operator may remove the clip 83 and then use water and soap or other detergent to clean the container, at that time the accumulation of dirt 81 is washed from the bag and the bag is now fully cleaned ready for reuse.

The superiority of my invention will be obvious from the foregoing detailed description. First, it will be seen that a minimum of solvent is required because of the close fitting of the walls of the container against the gun and because the shortening of the barrel-receiving portion. Also, if desired, the invention may be used to clean various firearm parts. The invention may be used with firearms having barrels 2 to 8 inches or greater in length, and if longer barrel guns are cleaned all that is necessary is to provide a container having a longer barrel-receiving portion.

The invention not only works on different lengths of barrels, but also on different makes of guns, such, for example, as Colt, Smith & Wesson, etc.

The invention very effectively cleans the critical portion of the gun because the critical portions are submerged in the solvent and because of the agitation which performs the cleaning action in the cartridge chamber, the face of the cylinder and the interior of the frame, particularly at the lower end of the cylinder.

When you are ready to remove the gun the draining action is extremely simple, you just remove the clip 70 and swing the folded portion into a lower position. Drainage, therefore, is simple and effective. Also, when the dirt has settled at the lower end of the barrel-receiving portion, it can be isolated as shown in FIG. 5 and the drained solvent can be decanted and used again. There also is an advantage in the compact arrangement because, as will be seen, the gun cleaning parts are relatively simple and take but little room when they are not in use. The structure provided is economical, low in sales price and well within costs which a gun user can afford to pay. No heat is required, and, therefore, the invention may be used where the gun has plastic sights, etc. Also, odors and evaporation are reduced to a very minimum because during the cleaning process the upper entrance opening of the bag is closed by the zipper 23. In using the invention, the steps are simple and easy to follow and take but a minimum of time.

I claim:

1. A gun cleaning system, the combination including:

a. a gun container having pouch adapted to receive a gun with its barrel pointed downward, and having an elongated barrel-receiving portion of reduced cross-sectional size, extending downwardly from said pouch;

b. said barrel-receiving portion being adjustable in length to accommodate the barrel of said gun;

c. a cleaning solution in said pouch filling said barrel-receiving portion; and d. means whereby said barrel-receiving portion may be elongated below said barrel to permit said cleaning solution to drain downwardly into a position below said gun barrel.

2. A combination as defined in claim 1 in which concontaminant in the cleaning solution which drains into the lower end of said barrel-receiving portion settles to the bottom of said barrel-receiving portion and may be isolated from said solution by folding said lower end to close it, whereafter said cleaning solution may be decanted from said container.

3. A combination as defined in claim 1 for cleaning the type of gun that has a cylinder with chambers therein and a barrel projecting forwardly therefrom in which agitation means is mounted on said gun at the outlet end of the cylinder thereof for causing agitation of said cleaning solution at the ends of said chambers whereby the cleaning solution in this area is agitated.

4. A combination as defined in claim 1 in which said barrel-receiving portion is made from a pliable material and is folded in order to shorten said barrel-receiving portion in order to adjust the length of said barrel-receiving portion to accommodate the length of the barrel of said gun, and in which the same may be unfolded in order to form a drain chamber below the lower end of the barrel of said gun.

5. A combination as defined in claim 3 in which said agitation means is in the form of a tube which extends around said gun adjacent the lower end of said cylinder, said tube being connected to a pressure pump and said tube having small openings which permit air to bubble through said cleaning solution for agitating same in order to remove burnt powder and lead from adjacent parts of said gun.

6. A combination as defined in claim 1 in which said gun container has means whereby it may be supported in a vertical position with the barrel-receiving portion pointed downwardly so that contaminant which is cleaned from the gun may gravitate to the lower end of the barrel-receiving portion.

7. A combination as defined in claim 5 in which said agitation means is provided with an adjustment means whereby the agitation means may be held in a desired position around the gun below the lower end of the cartridge cylinder.

8. A combination as defined in claim 5 in which said agitation means includes a pliable wire which may be bent in order to support the agitation means in a desired position on said gun.

* * * * *

UNITED STATES PATENT OFFICE

CERTIFICATE OF CORRECTION

Patent No. 4,045,900 Dated September 6, 1977

Inventor(s) John A. Byer

It is certified that error appears in the above-identified patent and that said Letters Patent are hereby corrected as shown below:

Column 1, line 37, heading for "INENTION" read --INVENTION--.

Column 6, line 7, after "which" cancel -- con- --.

Column 6, line 47, cancel "cartridge".

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*